US008919709B2

(12) United States Patent
Zhou et al.

(10) Patent No.: US 8,919,709 B2
(45) Date of Patent: Dec. 30, 2014

(54) LIFTING ROD DEVICE OF SHOWER

(75) Inventors: Huasong Zhou, Xiamen (CN); Shenghe Chen, Xiamen (CN); Xijie Deng, Xiamen (CN); Qingshuang Li, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 163 days.

(21) Appl. No.: 13/641,763

(22) PCT Filed: Apr. 28, 2011

(86) PCT No.: PCT/CN2011/073467

§ 371 (c)(1),
(2), (4) Date: Oct. 17, 2012

(87) PCT Pub. No.: WO2011/134413

PCT Pub. Date: Nov. 3, 2011

(65) Prior Publication Data

US 2013/0026317 A1 Jan. 31, 2013

(30) Foreign Application Priority Data

Apr. 30, 2010 (CN) ..... 2010 1 0161041
Apr. 30, 2010 (CN) ..... 2010 2 0176838 U

(51) Int. Cl.

| | |
|---|---|
| ***A47F 5/00*** | (2006.01) |
| ***A47F 7/00*** | (2006.01) |
| ***F16M 11/00*** | (2006.01) |
| ***F16M 13/00*** | (2006.01) |

(52) U.S. Cl.

USPC ..... 248/122.1; 4/570; 4/601; 4/605; 4/615; 248/121; 248/125.1; 248/229.14

(58) Field of Classification Search

USPC ..... 248/121, 229.14, 220.2, 229.11, 122.1; 137/343; 4/570, 601, 605, 615

See application file for complete search history.

(56) References Cited

U.S. PATENT DOCUMENTS

| | | | | |
|---|---|---|---|---|
| 2,496,520 | A * | 2/1950 | Daniel | 239/208 |
| 4,271,543 | A * | 6/1981 | Martin | 4/615 |
| 5,318,263 | A * | 6/1994 | Bischoff et al. | 248/220.22 |
| 7,918,424 | B1 * | 4/2011 | Wu et al. | 248/222.11 |
| 2009/0265848 | A1 * | 10/2009 | Tsai | 4/615 |

* cited by examiner

*Primary Examiner* — Amy J Sterling
(74) *Attorney, Agent, or Firm* — Rabin & Berdo, P.C.

(57) ABSTRACT

A lifting rod device of shower has a lifting rod, a sucker mechanism and a locking mechanism. A penetrating hole penetrates the upper end part. The locking mechanism has a support seat connected to the lifting rod, a lower wedge block that can be connected in the support seat in a forward and backward sliding manner, an upper wedge block that can be connected in the support seat in an upward and downward sliding manner and a nut, a transversal threaded rod is fixedly arranged on the lower wedge block, the threaded rod can rotationally pass through the support seat; the nut is screwed to the threaded rod and connected out of the support seat in a relying manner, and the lower wedge block can be driven to move forward and backward by rotating the nut.

8 Claims, 6 Drawing Sheets

LIFTING ROD DEVICE OF SHOWER

FIELD OF THE INVENTION

The present invention relates to a lifting rod device of shower.

BACKGROUND OF THE INVENTION

The traditional lifting rod device comprises an upper wall seat, a lower wall seat and a lifting rod, the upper and the lower wall seats are mechanically (for example using dowel to destroy the wall) fixed on the wall, and the lifting rod is fixed between the upper and the lower wall seat. Two wall seats are used in the traditional lifting rod device with enhancing construction difficulty and cost, and with increasing material and manufacture cost.

SUMMARY OF THE INVENTION

The object of the present invention is to offer a lifting rod device of shower which overcomes the defect of high manufacturing and construction cost of the lifting rod device at the prior.

The technical proposal solving the technical matter in the present invention is:

Lifting rod device of shower, it comprises:

A lifting rod, which is provided with an upper end part and a lower end part, and a penetrating hole penetrating from front to back is arranged at the upper end part;

A fixing mechanism that can be fixed to the fixing thing and is fixedly connected at the lower end part of the lifting rod; and A locking mechanism, which comprises a support seat fixedly connected to the lifting rod, a lower wedge block that can be connected in the support seat in a forward and backward sliding manner, an upper wedge block that can be connected in the support seat in an upward and downward sliding manner and a first nut, a transversal threaded rod is fixedly arranged on the lower wedge block, the threaded rod can rotationally pass through and extend out of the support seat; the first nut is screwed to the threaded rod and connected out of the support seat in a relying manner, and the lower wedge block can be driven to move forward and backward by rotating the first nut; the upper wedge block and the lower wedge block can adaptively rely on each other, and the forward and backward slide of the lower wedge block can drive the upward and downward slide of the upper wedge block to adjust the area of the penetrating hole.

In a preferred embodiment, the penetrating hole of the lifting rod is provided with an upper inner side and a lower inner side, and the upper inner side is arranged to be an upper semi-cylindrical surface; the locking mechanism also comprises a pipe-pressing rubber blanket which is fixedly connected on the upper wedge block, a lower semi-cylindrical surface is concavely arranged on the top surface of the pipe-pressing rubber blanket; the upper semi-cylindrical surface and the lower semi-cylindrical surface are adaptive to each other.

In a preferred embodiment, the support seat is fixedly arranged on the lower inner side of the penetrating hole of the lifting rod.

In a preferred embodiment, the fixing mechanism is a sucker mechanism.

In a preferred embodiment, the sucker mechanism comprises a sucker, a locating sleeve, a fixed seat and a second nut, the sucker is provided with a control rod, the locating sleeve is sleeved with the control rod, and the periphery of the sucker is pressed by the locating sleeve, the fixed seat is fixed at the lower end part of the lifting rod, the control rod is provided with a threaded rod segment which extends out of the fixed seat, the second nut is screwed to the threaded rod segment of the control rod and relies out of the fixed seat.

In a preferred embodiment, a guiding piece is convexly extends downward from the front end of the upper wedge block, a guiding hole is opened on the guiding piece, and the guiding piece is arranged between the lower wedge block and the support seat, and the threaded rod adaptively passes through the guiding hole.

In a preferred embodiment, a fixing slot is opened at the upper end of the upper wedge block, the lower end of the pipe-pressing rubber blanket is provided with a splicing part correspondingly, and a locating flange is formed on the lower semi-cylindrical surface of the upper part of the pipe-pressing rubber blanket, and the splicing part is inserted into the fixing slot to be fixed.

In a preferred embodiment, a sliding seat is arranged on the lifting rod.

Compared with the technical proposal at the prior, the benefits of the present invention are:

1. The penetrating hole of the lifting rod is first sleeved with the support arm when manufacturing, and then the upper wedge block is driven to slide upward by rotating the first nut to adjust the area of the penetrating hole and to lock and connect the support arm, so that the lifting rod device and the support arm are fixed, therefore: a. only one wall seat is needed to achieve the fixing of the lifting rod with low material and manufacture cost; b. it is easy to assemble and dismantle; c. it is no need to destroy the wall;

2. A pipe-pressing rubber blanket is arranged to lock the lifting rod device and the support arm tight;

3. The upper semi-cylindrical surface is adaptive to the lower semi-cylindrical surface, which is easy to lock the lifting rod device and the support arm tight;

4. The fixing mechanism is a sucker mechanism without destroying the wall;

5. The sucker mechanism comprises a sucker, a locating sleeve, a fixed seat and a second nut, the tightness of the whole sucker can be adjusted through the second nut.

REFERENCE SIGN

Figure 1:
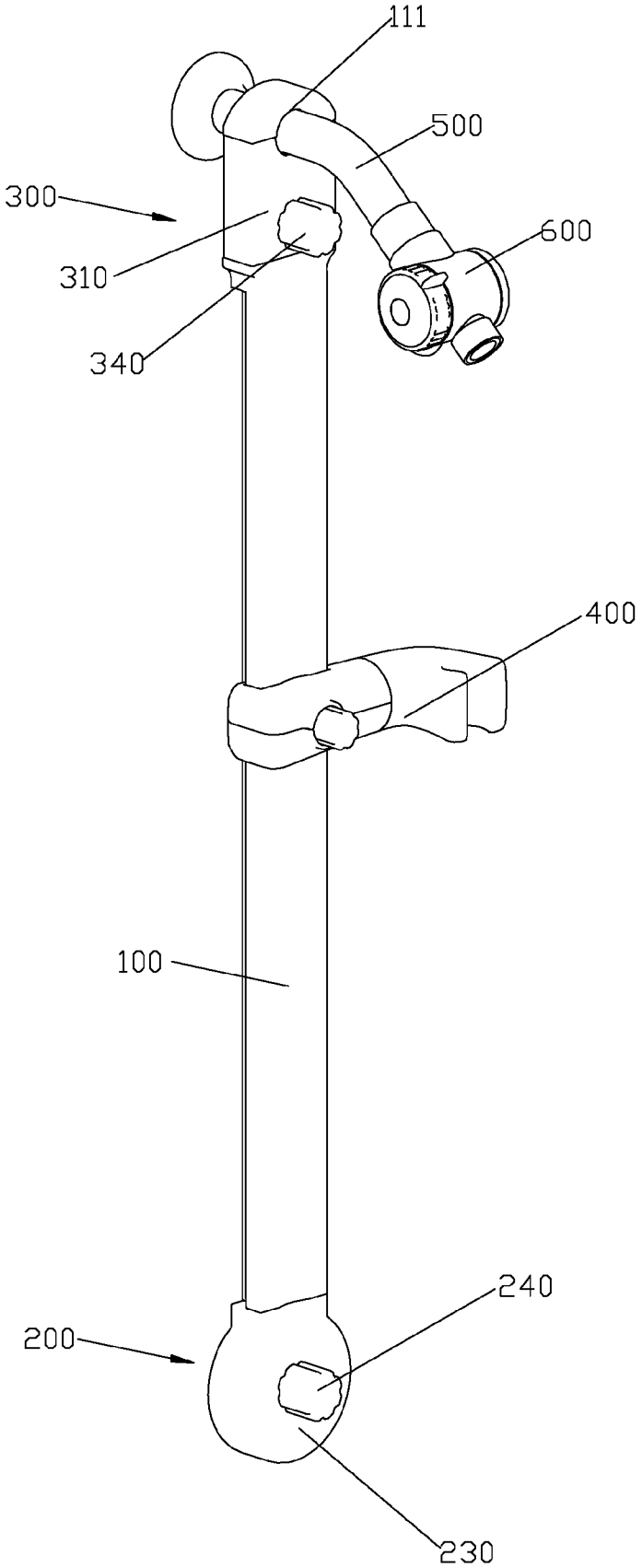
FIG. 1 shows the solid abridged general view of the lifting rod device.

Lifting rod 100, sucker mechanism 200, locking mechanism 300, sliding seat 400, support arm 500, three-way valve 600, penetrating hole 110, upper semi-cylindrical surface 111, sucker 210, locating sleeve 220, fixed seat 230, second nut 240, control rod 211, elastic buckle 231, support seat 310, lower wedge block 320, upper wedge block 330, first nut 340, pipe-pressing rubber blanket 350, splicing part 352, locating flange 353, transversal threaded rod 321, lower semi-cylindrical surface 351, guiding plate 331, guiding hole 332, fixing slot 333.

DESCRIPTION OF THE PREFERRED EMBODIMENTS

With the following description of the drawings and specific embodiments, the invention shall be further described in details.

Figure 2:
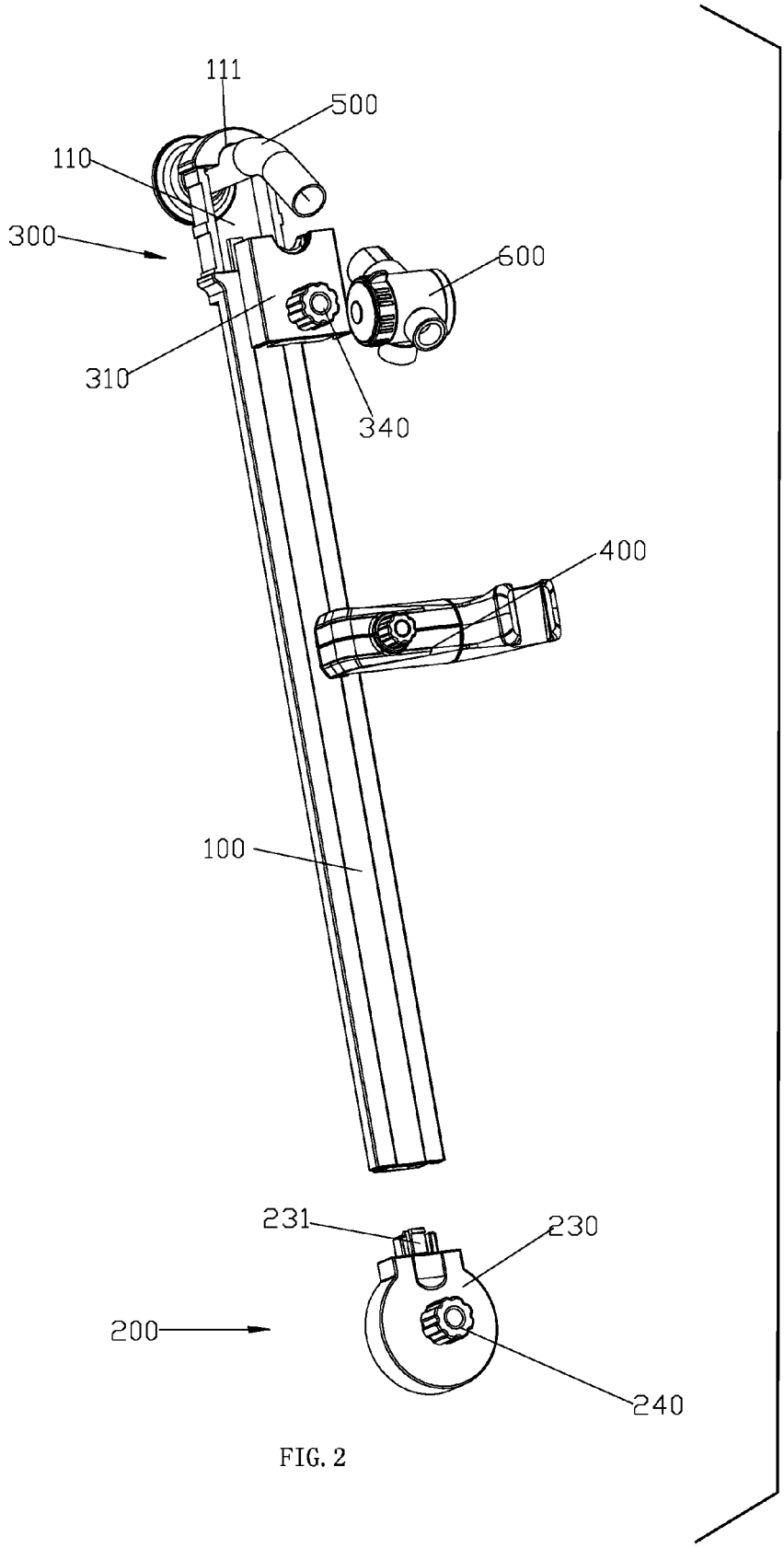
FIG. 2 shows the solid exploded view of the lifting rod device.
Figure 3:
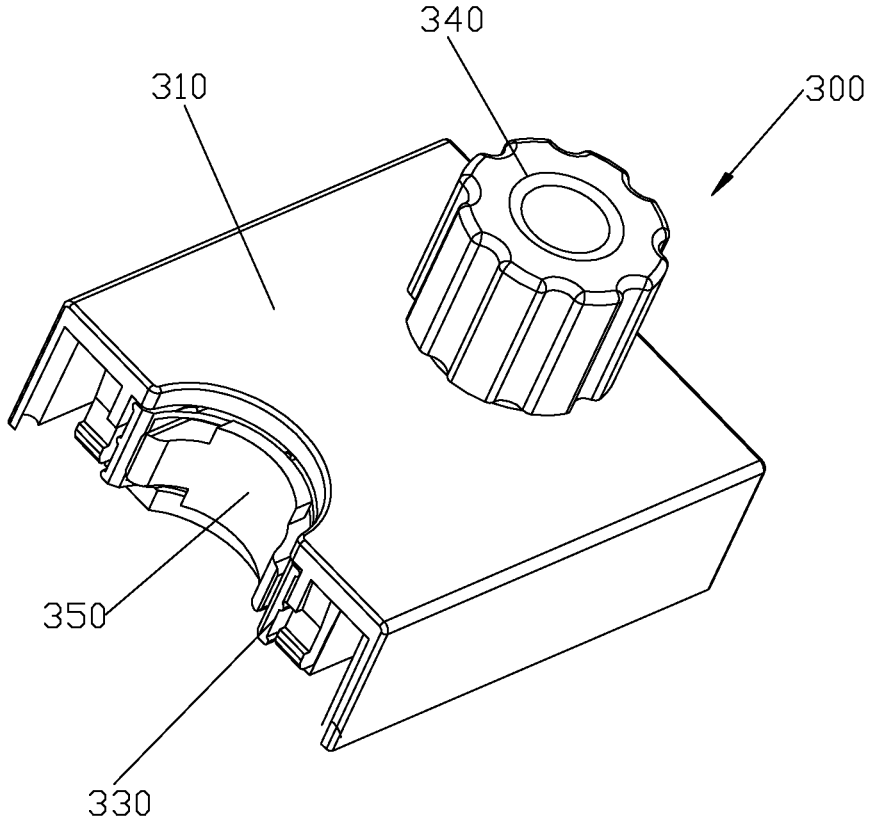
FIG. 3 shows the solid abridged general view of the locking mechanism of the lifting rod device.
Figure 4:
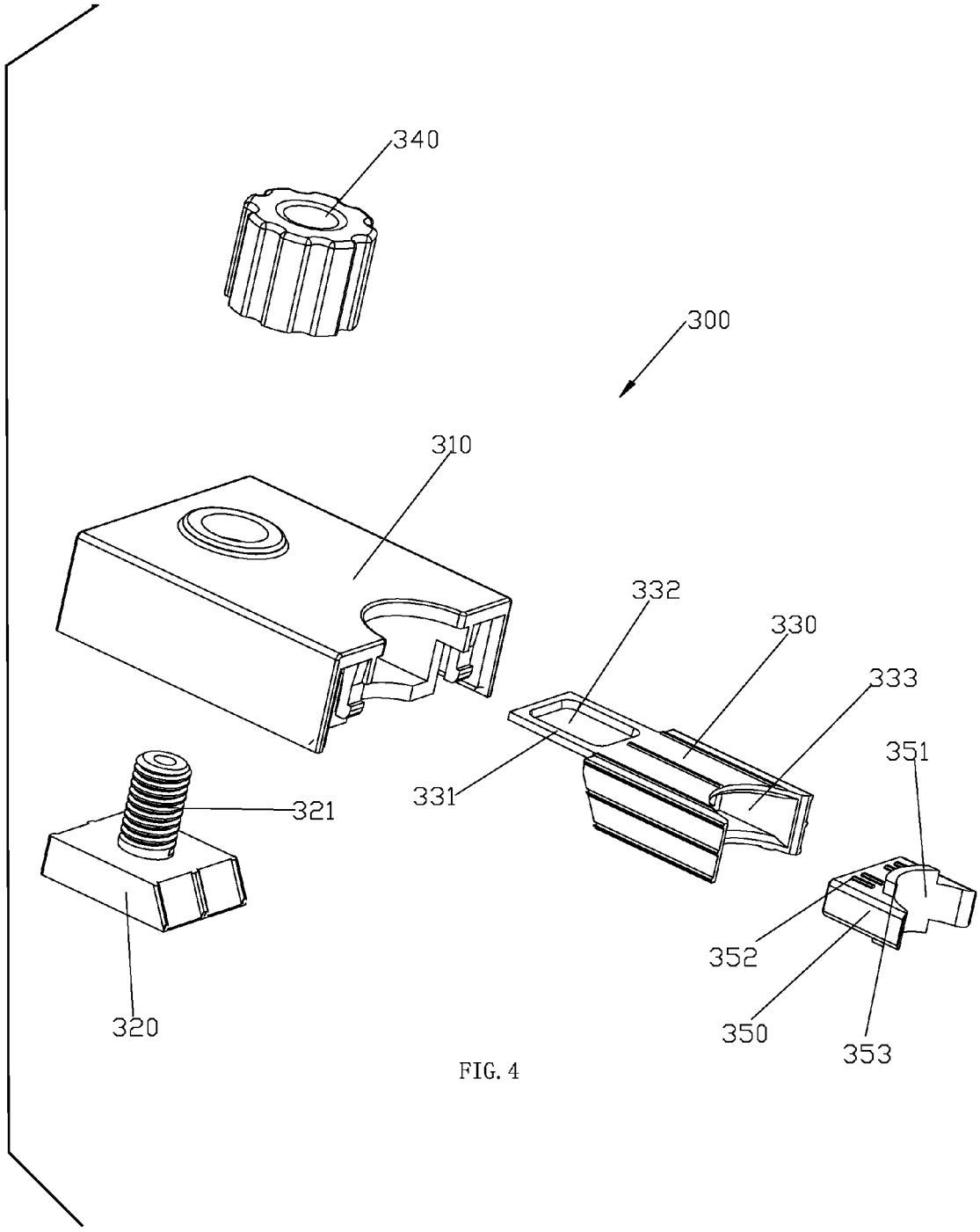
FIG. 4 shows the solid exploded view of the locking mechanism of the lifting rod device.
Figure 5:
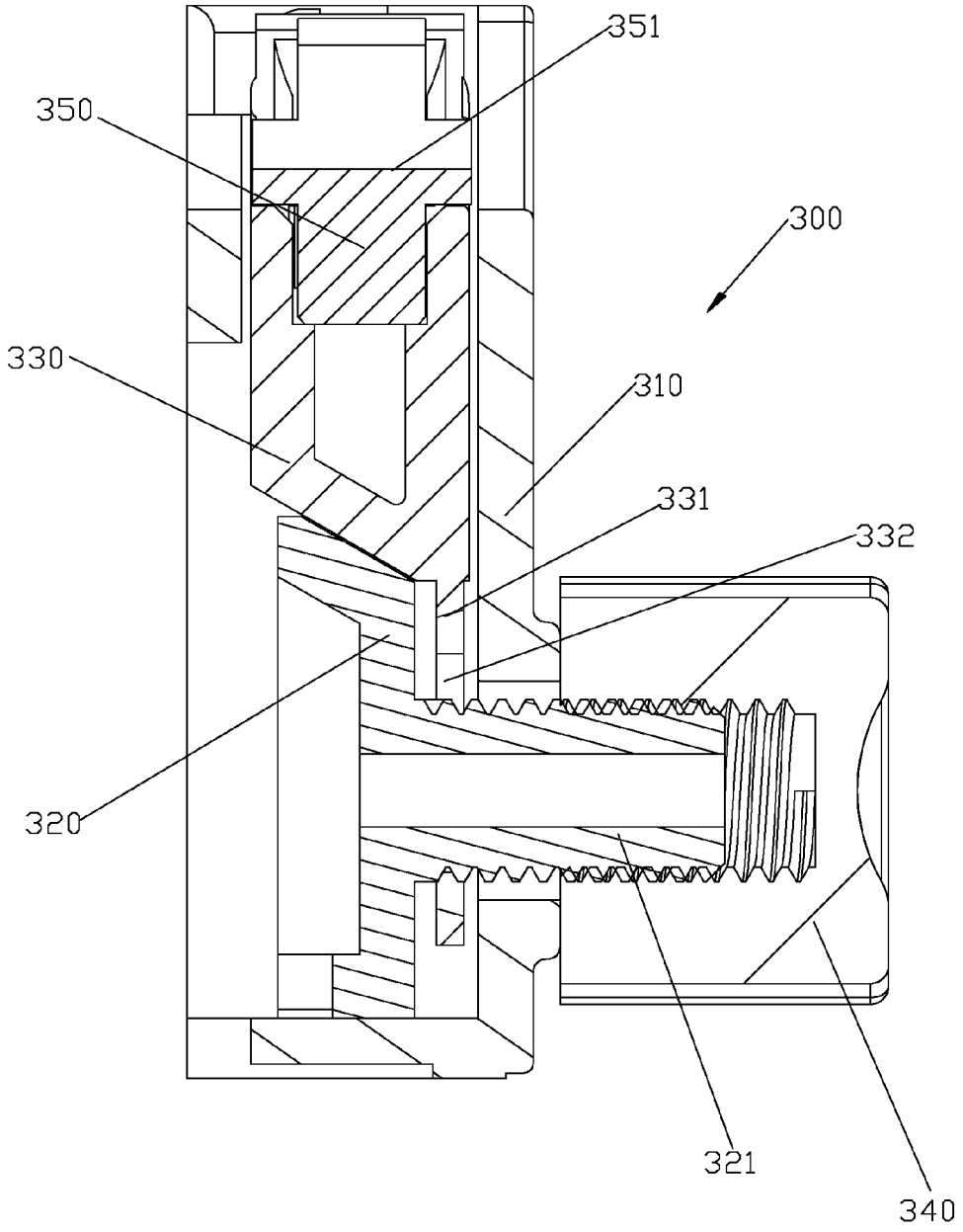
FIG. 5 shows the sectional view of the locking mechanism of the lifting rod device.
Figure 6:
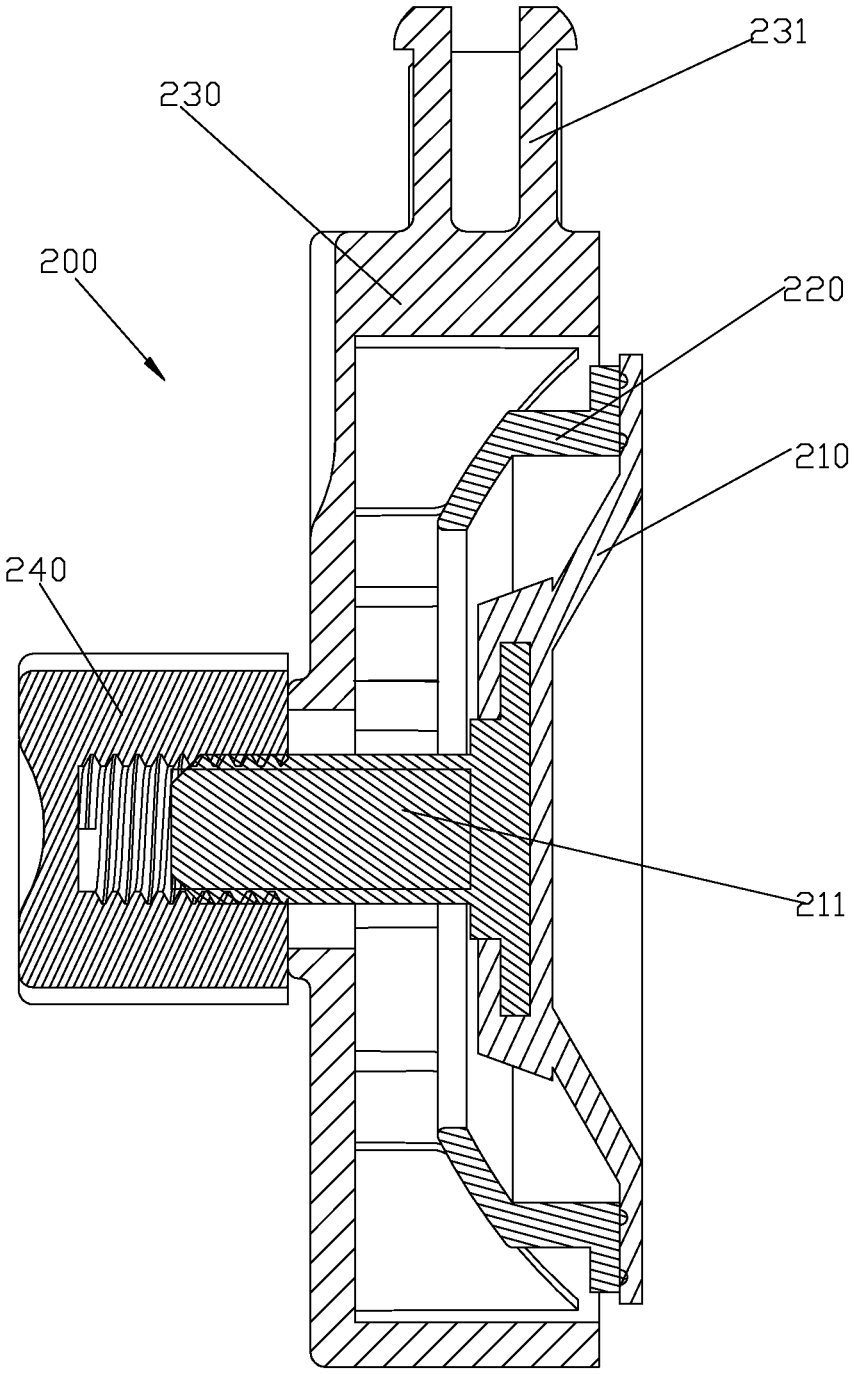
FIG. 6 shows the sectional view of the fixing mechanism of the lifting rod device.

According to FIG. 1 to FIG. 6, the lifting rod device of shower comprises a lifting rod 100, a sucker mechanism 200, a locking mechanism 300 and a sliding seat 400. The lifting rod device is connected to the support arm 500, and a three-way valve 600 is also connected to the support arm 500. The sliding seat 400 can be connected to the lifting rod 100 in an up-and-down sliding manner, which is used for splicing the handheld shower.

The lifting rod 100 is provided with an upper end part and a lower end part, a penetrating hole 110 penetrating from front to back is arranged at the upper end part 100. And the penetrating hole is provided with an upper inner side and a lower inner side, and the upper inner side is arranged to be a semi-cylindrical surface 111.

The sucker mechanism 200 comprises a sucker 210, a locating sleeve 220, a fixed seat 230 and a second nut 240, the sucker 210 and the locating sleeve 220 are arranged in the fixed seat 230. The sucker 210 is provided with a control rod 211 of which the end is arranged to be a threaded rod segment. The locating sleeve 220 is sleeved with the control rod 211, and the periphery of the sucker 210 is pressed by the back circumference of the locating sleeve 220. The end of the control rod 211 extends out of the fixed seat 230, and the second nut 240 is screwed to the threaded rod segment of the control rod 240 and is connected out of the fixed seat 230 in a relying manner. The control rod 211 can be controlled to move forward and backward by rotating the second nut 240, so that the tightness of the sucker 210 can be adjusted. An elastic buckle 231 is fixedly arranged on the top of the fixed seat 230 and is clamped at the lower end part of the lifting rod 100, so that the fixed seat 230 and the lifting rod 100 can be fixed together.

The locking mechanism 300 comprises a support seat 310, a lower wedge block 320, an upper wedge block 330, a first nut 340 and a pipe-pressing rubber blanket 350. The support seat 310 is fixedly arranged on the lower inner side of the penetrating hole 110 of the lifting rod 100.

The top surface of the lower wedge block 320 is arranged to be the first oblique surface facing forward and upward; a transversal threaded rod 321 is fixedly arranged on the lower wedge block 320; the lower wedge block 320 can be connected in the support seat 310 in a forward and backward sliding manner. The support seat 310 can be rotationally passed through by the threaded rod 321 that extends out of the support seat 310. The first nut 340 is screwed to the threaded rod 321 and is connected out of the support seat 310 in a relying manner, the lower wedge block can be driven to slide forward and backward by rotating the first nut 340.

The bottom surface of the upper wedge block 330 is arranged to be a second oblique surface adaptive to the first oblique surface and facing forward and upward; the upper wedge block 330 can be connected in the support seat 310 in an upward and downward sliding manner, and the second oblique surface of the upper wedge block 330 adaptively relies to the first oblique surface of the lower wedge block 320, so that the upward and downward slide of the first oblique surface can be driven by the forward and backward slide of the lower wedge block 320 to adjust the area of the penetrating hole 110.

The pipe-pressing rubber blanket 350 is fixedly connected on the upper wedge block 330, a lower semi-cylindrical surface 351 is concavely arranged on the top surface of the pipe-pressing rubber blanket, the upper semi-cylindrical surface 111 is adaptive to the lower semi-cylindrical surface 351 of the penetrating hole 110.

It is better that a guiding piece 331 is extended downward from the front end of the upper wedge block 330, on which a guiding hole 332 is opened and which is between the lower wedge block 320 and the support seat 310, and the threaded rod 321 is adaptively through the guiding hole 332, so that the extreme position of the up-and-down sliding can be limited and the up-and-down guiding can be achieved through the cooperation of the guiding hole 332 and the threaded rod 321.

It is better that a fixing slot 333 is opened at the upper end of the upper wedge block 330, and the lower end of the pipe-pressing rubber blanket 350 is provided with a splicing part 352 correspondingly, a locating flange 353 is formed on the lower semi-cylindrical surface 351 of the upper part of the pipe-pressing rubber blanket 350, and the splicing part 352 is inserted into the fixing slot 333 to be fixed.

In the present embodiment, because the sucker 210 and the locating sleeve are arranged in the fixed seat 230, and a locking mechanism is additionally arranged to adjust the area of the penetrating hole (namely the acting force between the upper wedge block and the support arm, the friction force between the pipe-pressing rubber blanket and the support arm are adjusted), the lifting rod 110 can rely on the wall.

For better understanding the present invention, the principle of the lifting rod device is introduced below in details: the penetrating hole 110 of the lifting rod 100 is sleeved with the support arm 500, and the upper semi-cylindrical surface 111 is sleeved with the support arm 500; the first nut 340 is rotated, so that the lower wedge block 320 slides downward, and the upper wedge block 330 slides upward through the cooperation of the first oblique surface and the second oblique surface, and then the pipe-pressing rubber blanket 350 slides upward to rely tightly under the support arm 500, and then the fixing between the lifting rod device and the support arm 500 is locked tightly; the sucker mechanism 200 is fixed at the lower end part of the lifting rod 100; and the sucker mechanism 200 fixedly absorbs the wall.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The lifting rod device of shower in the present invention, the penetrating hole of the lifting rod can first be sleeved with the support arm when assembling, and then the upper wedge block is driven to slide upward by rotating the first nut to adjust the area of the penetrating hole (locking and connecting the support arm), so that the lifting rod device and the support arm are fixed, therefore only a wall seat is needed to achieve the fixing of the lifting rod with low cost of material and construction.

What is claimed is:

1. Lifting rod device of shower, comprising:

a lifting rod, which is provided with an upper end part and a lower end part, and a penetrating hole penetrating from front to back arranged at the upper end part, the penetrating hole provided with an upper inner side and a lower inner side;

a fixing mechanism that can be fixed to a fixed thing and is fixedly connected to the lower end part of the lifting rod; and a locking mechanism, which comprises a support seat fixedly connected to the lifting rod, a lower wedge block that can be connected in the support seat in a forward and backward sliding manner, an upper wedge block that can be connected in the support seat in an upward and downward sliding manner and a first nut, a transversal threaded rod is fixedly arranged on the lower wedge block, the threaded rod can rotationally pass through and extend out of the support seat; the first nut is screwed to the threaded rod and connected out of the support seat, and the lower wedge block can be driven to move forward and backward by rotating the first nut; the upper wedge block and the lower wedge block can adaptively rely on each other, and the forward and backward slide of the lower wedge block can drive the upward and downward slide of the upper wedge block to adjust the area of the penetrating hole by moving the lower inner side of the penetrating hole.

2. Lifting rod device of shower according to claim 1, wherein, the upper inner side is arranged to be an upper semi-cylindrical surface; the locking mechanism also comprises a pipe-pressing rubber blanket which is fixedly connected on the upper wedge block, a lower semi-cylindrical surface is concavely arranged on the top surface of the pipe-pressing rubber blanket; the upper semi-cylindrical surface and the lower semi-cylindrical surface are adaptive to each other.

3. Lifting rod device of shower according to claim 2, wherein, the support seat is fixedly arranged on the lower inner side of the penetrating hole of the lifting rod.

4. Lifting rod device of shower according to claim 1, wherein, the fixing mechanism is a sucker mechanism.

5. Lifting rod device of shower according to claim 4, wherein, the sucker mechanism comprises a sucker, a locating sleeve, a fixed seat and a second nut, the sucker is provided with a control rod, the locating sleeve is sleeved with the control rod, and the periphery of the sucker is pressed by the locating sleeve, the fixed seat is fixed at the lower end part of the lifting rod, the control rod is provided with a threaded rod segment which extends out of the fixed seat, the second nut is screwed to the threaded rod segment of the control rod and relies out of the fixed seat.

6. Lifting rod device of shower according to claim 1, wherein, a guiding piece convexly extends downward from the front end of the upper wedge block, a guiding hole is opened on the guiding piece, and the guiding piece is arranged between the lower wedge block and the support seat, and the threaded rod adaptively passes through the guiding hole.

7. Lifting rod device of shower according to claim 1, wherein, a fixing slot is opened at the upper end of the upper wedge block, the lower end of the pipe-pressing rubber blanket is provided with a splicing part correspondingly, and a locating flange is formed on the lower semi-cylindrical surface of the upper part of the pipe-pressing rubber blanket, and the splicing part is inserted into the fixing slot to be fixed.

8. Lifting rod device of shower according to claim 1, wherein, a sliding seat is arranged on the lifting rod.

* * * * *